United States Patent [19]

Takeuchi et al.

[11] 4,314,535

[45] Feb. 9, 1982

[54] FEEDBACK TYPE VARIABLE VENTURI CARBURETOR

[75] Inventors: Yuzu Takeuchi, Nagoya; Shigetaka Takada, Ohbu; Toshiharu Morino, Mie, all of Japan

[73] Assignee: Aisan Industry Co., Ltd., Aichi, Japan

[21] Appl. No.: 150,774

[22] Filed: May 19, 1980

[30] Foreign Application Priority Data

May 30, 1979 [JP] Japan ..... 54-66996

[51] Int. Cl.[3] ..... F02B 33/00; F02M 7/00

[52] U.S. Cl. ..... 123/439; 123/438

[58] Field of Search ..... 123/439, 438, 440; 261/DIG. 74, 44 C, 121 B, 23 A

[56] References Cited

U.S. PATENT DOCUMENTS

| | | | |
|---|---|---|---|
| 3,911,884 | 10/1975 | Moriya | 123/440 |
| 3,963,009 | 6/1976 | Mennesson | 123/440 |
| 3,974,813 | 8/1976 | Knapp | 123/439 |
| 4,089,311 | 5/1978 | Brehschneider | 123/440 |
| 4,091,781 | 5/1978 | Mituyasu | 123/440 |
| 4,167,547 | 9/1979 | Takamaru | 123/439 |

*Primary Examiner*—Ronald B. Cox

[57] ABSTRACT

A feedback type variable venturi carburetor in which the negative pressure regulated by the variable venturi at a constant level is supplied to a solenoid valve which is opened and closed at a frequency of 5–30 Hz and whose open-close time ratio is controlled in accordance with the signal from exhaust gas sensor to control the vacuum pressure applied to a diaphragm chamber of an air-bleed flow control means thereby controlling the air-fuel ratio of the mixture at an optimum level. This invention obviates the use of a regulator for regulating the negative pressure from the intake manifold and precludes the drawbacks experienced with conventional carburetors, such as the slow response in the feedback control caused when the main fuel system and the idling system of the conventional carburetor are switched over, and the unstable supply of fuel when the fuel begins to be delivered from the main fuel system.

9 Claims, 7 Drawing Figures

FEEDBACK TYPE VARIABLE VENTURI CARBURETOR

BACKGROUND OF THE INVENTION

The present invention relates to a variable venturi carburetor which is feedback-controlled with the air of an exhaust gas sensor.

FIG. 1 shows a construction of the conventional feedback type carburetor. In this carburetor, the signal from an exhaust gas sensor 4 is sent to a control circuit 7 where it is compared with the target air-fuel ratio. The control circuit 7 then supplies a control signal based on the comparison to an actuator 6 to control the amount of air bleed to be supplied to the main fuel system or the idling system of the carburetor 5 so as to maintain the air-fuel ratio of the mixture at an optimum value. The conventional carburetor has the main fuel system and the idling system and there is a substantial time lag after the two fuel systems have been switched over until a desired amount of fuel is supplied to the intake manifold. The conventional carburetor also has the following drawbacks: when the fuel begins to be supplied from the main fuel system, the vacuum pressure level at the main nozzle 5-3 is not sufficiently high so that the fuel is injected irregularly and non-uniformly and therefore the air-fuel ratio of the mixture fluctuates greatly; and the amount of air bleed for both fuel systems must be controlled simultaneously. In other conventional carburetors (not shown), the negative pressure derived from the intake manifold is regulated at a constant vacuum level and is further controlled at a desired level by the solenoid valve whose open-close time ratio (duty ratio) has a linear relationship with the controlled vacuum level and which is determined on the basis of the signal from the exhaust gas sensor. The controlled vacuum pressure is then admitted to a vacuum diaphragm chamber of an air-bleed control means to control the amount of air bleed and thereby control the richness of the mixture to be drawn into the engine. This type of carburetor requires a regulator means to regulate the negative pressure derived from the intake manifold at a constant level. The former type of carburetor has the problems of slow feedback response when the two fuel systems are switched over, and of uneven supply of fuel when the fuel begins to be delivered from the main fuel system.

SUMMARY OF THE INVENTION

An object of this invention is to provide a feedback type variable venturi carburetor which overcomes the drawbacks experienced with the feedback system of the conventional carburetors.

To achieve this objective, a feedback type variable venturi carburetor of this invention comprises: a variable venturi carburetor; an exhaust gas sensor; a means for controlling the air bleed area; a three-way solenoid valve which performs on-off operation; and a control circuit for controlling the solenoid valve in accordance with the signal from the exhaust gas sensor; whereby one of the passages of the three-way solenoid valve communicates to a vacuum source whose negative pressure is controlled at a constant vacuum level by the variable venturi, a second passage communicates to the atmosphere, and a third passage of the three-way solenoid valve communicates to a vacuum chamber of the air bleed area control means, the chamber being formed with a diaphragm or bellows.

DESCRIPTION OF THE PREFERRED EMBODIMENTS

Preferred embodiments of this invention will now be described with reference to the accompanying drawings.

Figure 1:
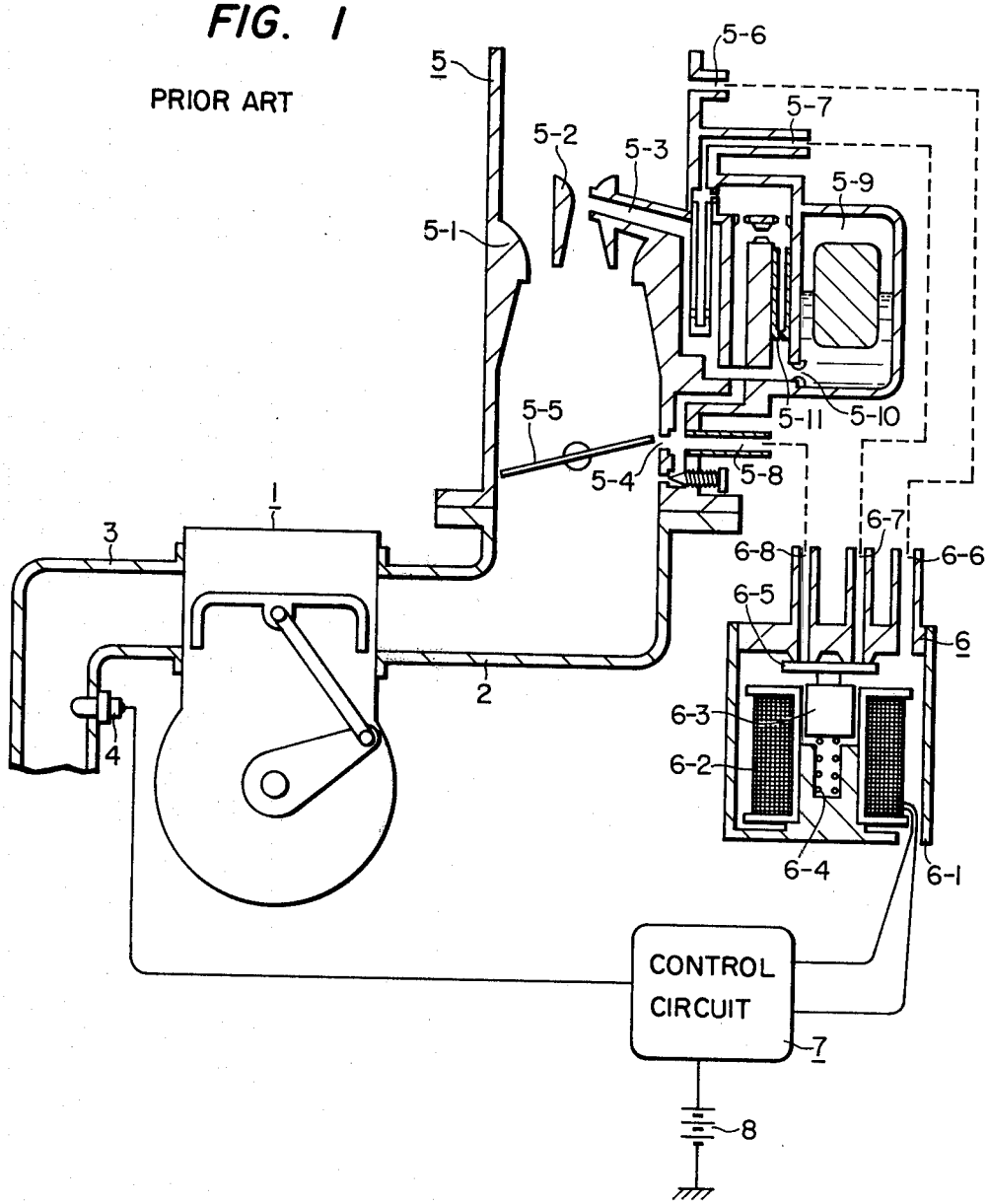
FIG. 1 PRIOR ART
FIG. 1 is a schematic view showing the conventional feedback type carburetor.
Figure 2:
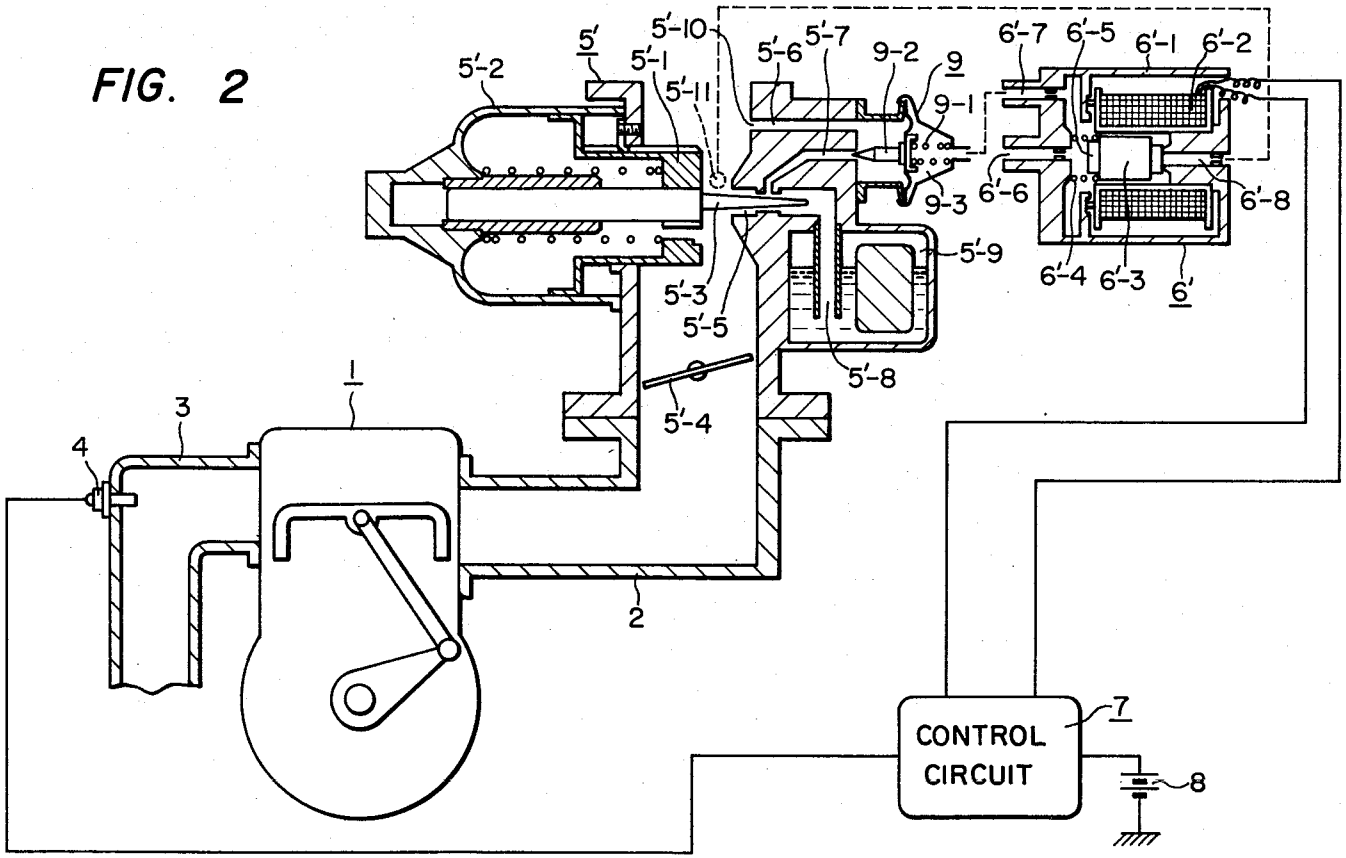
FIG. 2 is a schematic view showing the feedback type carburetor of this invention.
Figure 3:
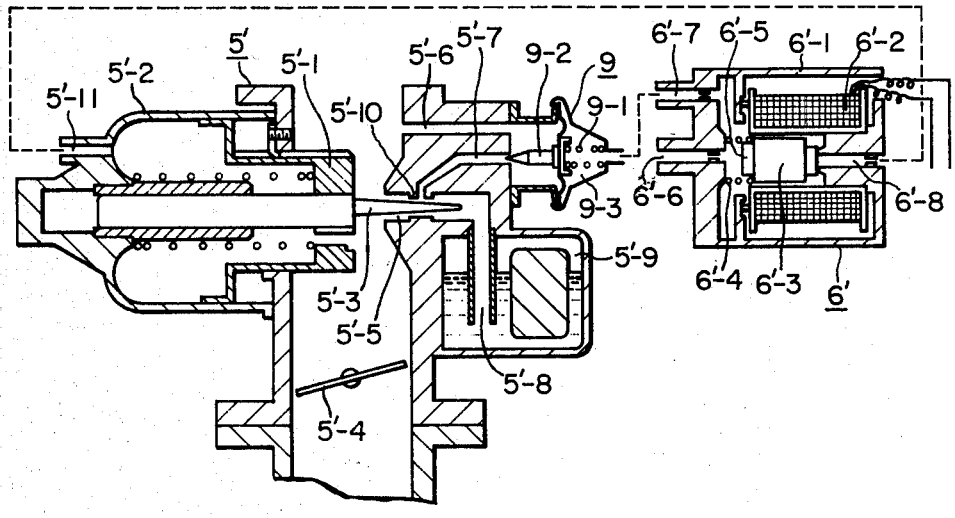
FIGS. 3 through 5 illustrates other embodiments of this invention.
Figure 4:
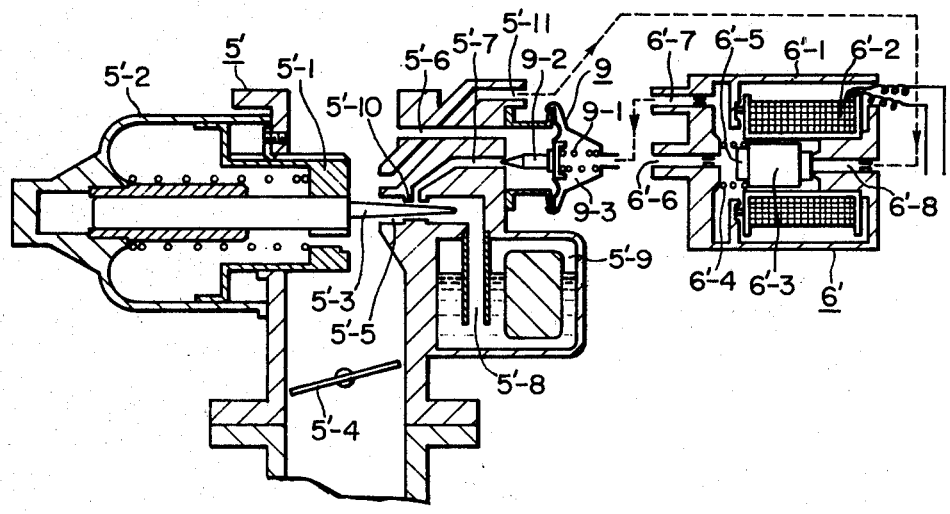
Figure 5:
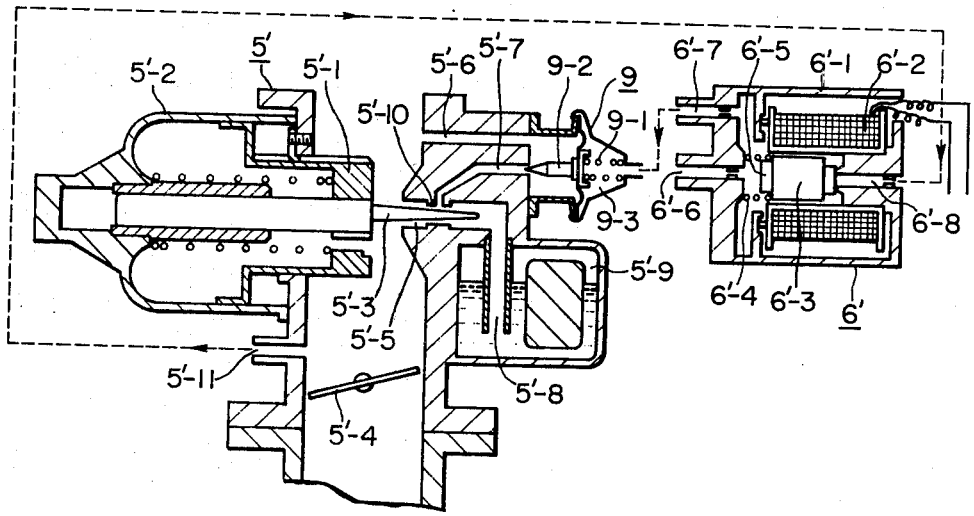
Figure 6:
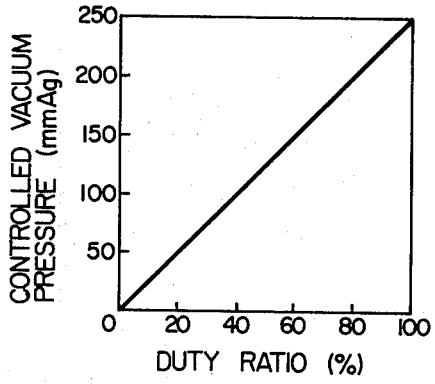
FIG. 6 is a diagram showing the relation between the duty ratio of the solenoid valve and the controlled vacuum pressure.
Figure 7:
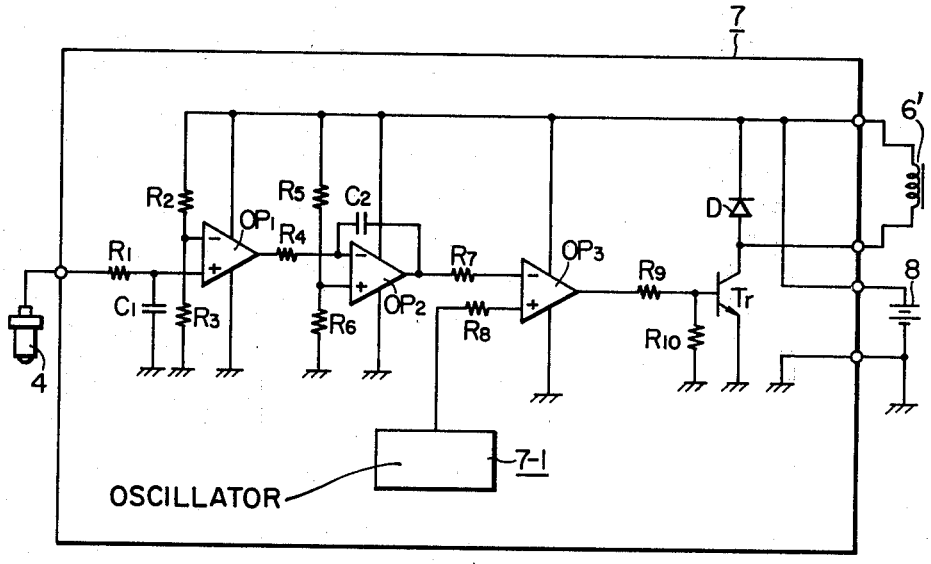
FIG. 7 is a circuitry showing one embodiment of the control circuit of this invention.

FIG. 2 is a schematic view of the system of this invention; FIGS. 3 through 5 show other embodiments with the negative pressure port at different locations; FIG. 6 is a diagram showing the relation between the duty ratio of a solenoid valve and the controlled negative pressure; and FIG. 7 shows a control circuit constructed according to this invention.

Reference numeral 1 represents an engine body, 2 an intake manifold, 3 an exhaust manifold, 4 an exhaust gas sensor, 5' a variable venturi type carburetor used in this invention, 5'-1 a piston, 5'-2 a piston housing, 5'-3 a metering needle, 5'-4 a throttle valve, 5'-5 a fuel delivery port, 5'-6 an air bleed inlet port, 5'-7 an air bleed outlet port, 5'-8 a fuel passage, 5'-9 a float chamber, 5'-10 a main fuel jet, 5'-11 a regulated negative pressure port from which a constant negative pressure is admitted to a solenoid valve, 6' a solenoid valve, 6'-1 an outer case, 6'-2 a coil, 6'-3 a movable core, 6'-4 a spring, 6'-5 a valve, 6'-6 a port opening into the atmosphere, 6'-7 a controlled negative pressure delivery port, 6'-8 a regulated negative pressure inlet, 7 a control circuit, R1 to R10 resistors, C1 and C2 condensers, OP1 to OP3 operational amplifiers, D a diode, TV a power transistor, 7-1 an oscillator, and 8 a battery.

In FIG. 2, a signal from the exhaust gas sensor 4 is compared with a target air-fuel ratio by the control circuit 7 which, based on the deviation of the actual air-fuel ratio from the target air-fuel ratio, sends a control signal to the solenoid valve 6'. The solenoid valve 6' then opens or closes its valve according to the control signal to control the negative pressure at the controlled negative pressure delivery port 6'-7 to a desired level. The controlled negative pressure is then conducted into a diaphragm chamber 9-3 of an air bleed flow control valve means 9 to actuate a needle valve 9-2 thereof and control the amount of air bleed to indirectly control the fuel flow from the main fuel jet 5'-10 and thereby control the richness of the air-fuel mixture drawn into the engine 1. The regulated negative pressure port 5'-11 from which the regulated negative pressure is admitted to the regulated negative pressure inlet 6'-8 of the solenoid valve 6' may be provided at a venturi of the carburetor as shown in FIG. 2, or at a negative pressure chamber of the piston as shown in FIG. 3, or at the body opposite to the top of the piston as shown in FIG. 4, or between the throttle valve 5'-4 and the piston 5'-1 as shown in FIG. 5. In any case, the negative pressure port 5'-11 is provided at locations where the negative pressure can be regulated at a certain pressure.

We will explain the action of the carburetor of this invention in the following. Suppose that the negative pressure at the regulated negative pressure inlet 6'-8 of the solenoid valve 6' is regulated at 250 mmAq (the pressure is regulated at a constant value by the action of the piston 5'-1 and a spring).

The circuit for the coil 6'-2 of the electromagnetic valve 6' is turned on and off alternately to energize and deenergize the coil so that the movable core 6'-3 and the valve 6'-5 closes and opens the open air port 6'-6 and the regulated negative pressure inlet 6'-8 alternately. This produces a negative pressure at the controlled negative pressure delivery port 6'-7, the vacuum level of which is a function of the duty ratio as shown in FIG. 6. The negative pressure thus controlled is admitted to the diaphragm chamber 9-3 to control the metering needle valve 9-2 and therefore the air flow area between the needle valve and its seat. As the air flow area increases, the amount of fuel passing through the main fuel jet 5'-10 decreases. Conversely, as the air flow area decreases, the amount of fuel increases. That is, the amount of fuel supplied through the main fuel jet 5'-10 is a function of the duty ratio of the electromagnetic valve 6' and thus the air-fuel ratio of the mixture drawn into the engine can be controlled by the duty ratio.

Referring to FIG. 7 showing the control circuit, the signal from the exhaust gas sensor 4 is passed through a filter made up of a resistor R1 and a condenser C1 and is compared by the operational amplifier with the target voltage as defined by a split resistor consisting of resistors R2, R3. The operational amplifier OP1 then outputs a "high" or "low" level signal which is integrated by an integrator made up of a resistor R4, a condenser C2, an operational amplifier OP2. The integrated signal is now compared with a signal from an oscillator 7-1 and is pulse-modulated (duty-ratio conversion) by an operational amplifier OP3. The pulse-modulated signal is transferred to a power circuit consisting of resistors R9, R10 to energize the electromagnetic valve 6'.

In general variable venturi type carburetors, the negative pressure at the throttled portion of the venturi is admitted through the head of the piston 5'-1 to the control chamber of the piston and is controlled at an almost constant value by the balance between the spring load and the negative pressure force so as to make constant the air velocity at the throttled portion. The drive frequency of the electromagnetic valve 6' is preferably higher than 5 Hz where vibration of such degree does not have adverse effects on the controlled negative pressure delivery port 6'-7 and the diaphragm vacuum chamber 9-3 but less than 30 Hz where no problem arises to the response and durability of the valve 6'-4.

This invention is applicable to a downdraft type variable venturi carburetor.

As can be seen in the foregoing, this invention, employing the constant negative pressure and the drive frequency (5–30 Hz), has the following advantages over the conventional devices in which the negative pressure derived from the intake manifold is regulated by regulators: That is, the regulators are obviated; there is no problem of response delay such as experienced with the conventional carburetors when the fuel is switched over from the idling system to the main fuel system; since the velocity of air flow passing through the venturi is high and almost constant, stable delivery and atomization of fuel is insured; and a quick response is obtained in the control system.

If this invention is applied to a downdraft type variable venturi carburetor in which the riser heat will help atomize the fuel, the cost will greatly be reduced as compared with the conventional twin type variable venturi carburetor since in the former type only a single venturi is required.

What is claimed is:

1. A feedback type variable venturi carburetor for an engine comprising an intake manifold and a main fuel jet communicating therewith, a variable venturi including a movable piston movably extending into said intake manifold cooperating with said main fuel jet.

means defining an air bleed passage opening into said main fuel jet, said piston of said variable venturi constituting means for controlling a negative pressure to a substantially constant value defining a vacuum source, an exhaust manifold communicating downstream of said engine, an exhaust gas sensor disposed in said exhaust manifold, control valve means for varying an amount of main air bleed through said air bleed passage and disposed at a point along said air bleed passage, a three-way solenoid valve means operatively connected to said control valve means, a control circuit means operatively connected to said exhaust gas sensor for controlling said three-way solenoid valve means to regulate said control valve means and the amount of the main air bleed, said three-way solenoid valve means for performing an ON-OFF operation in accordance with a signal from said exhaust gas sensor via said control circuit means and having a first passage communicating with said vacuum source, a second passage opening to the atmosphere, a third passage communicating with said control valve means and constituting the operative connection thereto, and a movable iron core means operatively controlled by said control circuit means for executing a valve operation, one end of said movable iron core means operatively openingly and closingly respectively cooperating with said second passage and another end of said iron core means operatively closingly and openingly respectively cooperating with said first passage, respectively, and means for biasing said iron core means to close said first passage at all times.

2. The feedback type variable venturi carburetor as set forth in claim 1, wherein said first passage of said three-way solenoid valve means communicates with a throttled portion of said variable venturi in said intake manifold, said throttled portion constituting said vacuum source of negative pressure.

3. The feedback type variable venturi carburetor as set forth in claim 1, further comprising a throttle valve disposed in said intake manifold, said first passage of said three-way solenoid valve means communicates with a portion of said intake manifold between said variable venturi and said throttle valve, said portion having therein said vacuum source of negative pressure.

4. The feedback type variable venturi carburetor as set forth in claim 1, wherein said piston of said variable venturi defines therein a negative pressure piston chamber constituting said vacuum source of negative pressure, said first passage of said three-way solenoid valve means communicates with said piston chamber.

5. The feedback type variable venturi carburetor as set forth in claim 1, 2, 3, or 4, wherein said control circuit means is for controlling opening and closing of said three-way solenoid valve means at a frequency of 5–30 Hz and controlling the duty ratio thereof to a desired value.

6. The feedback type variable venturi carburetor as set forth in claim 5, wherein said feedback type variable venturi carburetor constitutes a downdraft type variable type carburetor.

7. The feedback type variable venturi carburetor as set forth in claim 1, 2, 3, or 4, wherein said feedback type variable venturi carburetor constitutes a downdraft type variable type carburetor.

8. The feedback type variable venturi carburetor as set forth in claim 1, wherein said control valve means includes a diaphragm and a metering needle valve connected thereto entering into said air bleed passage.

9. The feedback type variable venturi carburetor as set forth in claim 1, wherein said iron core means opens one of said first and second passages and closes the other, respectively, said first and second passages communicate respectively with said third passage in said solenoid valve means via said iron core means.

* * * * *